United States Patent [19]

Koslowski

[11] Patent Number: 4,593,503

[45] Date of Patent: Jun. 10, 1986

[54] ADJUSTABLE STAIR GUIDE AND SUPPORT

[76] Inventor: Georg Koslowski, 6915 Marine Drive, West Vancouver, British Columbia V7W 2T4, Canada

[21] Appl. No.: 494,759

[22] Filed: May 13, 1983

[51] Int. Cl.[4] ..... E04F 11/00

[52] U.S. Cl. ..... 52/188; 52/182; 52/183; 52/741

[58] Field of Search ..... 52/182, 183, 191, 109, 52/188, 30, 741; 182/95, 96, 1; 14/69.5, 71.1, 72.5

[56] References Cited

U.S. PATENT DOCUMENTS

| | | | |
|---|---|---|---|
| 1,128,212 | 2/1915 | Woolard | 182/95 |
| 2,245,825 | 6/1941 | Ross | 52/183 |
| 2,575,615 | 11/1951 | Crump | 182/95 |
| 2,879,556 | 3/1959 | Lyons | 52/191 |
| 3,626,438 | 12/1971 | Cornell | 52/183 |
| 3,885,365 | 5/1975 | Cox | 52/183 |
| 3,962,838 | 6/1976 | Cox | 52/183 |
| 4,020,920 | 5/1977 | Abbott | 182/96 |
| 4,124,957 | 11/1978 | Poulain | 52/183 |

FOREIGN PATENT DOCUMENTS

| | | | |
|---|---|---|---|
| 810303 | 3/1959 | United Kingdom | 182/95 |

*Primary Examiner*—Alfred C. Perham

*Attorney, Agent, or Firm*—Ward Brown; Robert W. Beach

[57] ABSTRACT

Several horizontal links have inward-projecting horizontal flanges for supporting the treads of a stairway. Such links are uniformly spaced apart elevationally by upright parallel links pivoted to the horizontal links to form a lazy tongs linkage. One such lazy tongs linkage is permanently attached in inclined attitude to the conventional weight-bearing supports for the stair treads, such as sidewalls or inclined stringers, at each side of the rough opening for the stairway. Prior to permanent installation, the lazy tongs linkage can be extended or contracted by conjoint swinging of the upright links to adjust the spacing of the horizontal tread support flanges so that the total rise of the linkage matches the total rise between adjacent floors as actually constructed. The support is designed to fit a range of expected total rises between the adjacent floors while maintaining a rise and run for each step within acceptable limits.

4 Claims, 13 Drawing Figures

U
T
12
S
1
2
D
Z

90°
L
4
4
U

ADJUSTABLE STAIR GUIDE AND SUPPORT

BACKGROUND OF THE INVENTION

1. Field of the Invention

The present invention relates to horizontal tread support brackets or flanges attachable to sidewalls or stringers for carrying the weight of the treads and risers in a permanent stairway construction. More specifically, the present invention relates to a lazy tongs adjustable stair guide and support in which horizontal links having tread support flanges are uniformly spaced and interconnected by parallel, upright links.

2. Prior Art

It is conventional to frame a multistory building structure leaving a rough opening for a stairway between floors. The stairway then is laid out and constructed on the job after the vertical distance between the floors is known precisely. Notches can be cut in inclined stringers to support the ends of the stair treads and risers. The rise and run of each step must be substantially the same as the rise and run of each of the other steps, and within acceptable ranges as specified in the appropriate building code.

Even for multistory buildings having identical floor plans, the vertical distance between floors may vary depending upon the framing components used. For example, in conventional wood construction of residential buildings the vertical distance between floors will be approximately equal to the total of: the thickness of the bottom plate, the length of the studs, the thickness of the top plate or plates, the depth of the joists supporting the upper floor and the thickness of the subflooring material for the upper floor. The joists supporting the upper floor can be nominal "2×8", "2×10", or "2×12" lumber, and subflooring material of different thicknesses can be used depending on the spacing of the joists.

A problem with the conventional stairway construction is that it takes a substantial period to lay out and notch the stringers to assure that the rise and run of each step are uniform and within the range required by the building code.

Lyons U.S. Pat. No. 2,879,556, issued Mar. 31, 1959, discloses a stringer and template for stairway construction in the form of a strip of sheet metal that can be attached to unnotched, inclined stringers. The metal strip has tread and riser support flanges bent inward at right angles from the remaining, upright portion of the strip. The rise and run of each step is predetermined and cannot be adjusted to accommodate a range of vertical distances between floors.

SUMMARY OF THE INVENTION

The principal object of the present invention is to provide a novel, simple and inexpensive permanent stairway construction.

In accordance with the principal object, it is an object to provide such a construction using primarily conventional materials, namely, conventional treads, risers and weight-bearing supports for the treads and risers, such as sidewalls or inclined stringers flanking the treads and risers, but adapting the construction to different vertical distances between floors, without requiring time-consuming calculations or layout to assure a uniform, acceptable rise and run of each step of the stairway.

The foregoing objects can be accomplished by providing an adjustable stair guide and support having several horizontal links with horizontal flanges for supporting the treads of the stairway, such horizontal links being uniformly spaced apart elevationally by parallel upright links pivoted to the horizontal links to form lazy tongs. In a stairway installation, one such lazy tongs support is permanently attached to the conventional weight-bearing supports for the stair treads and risers at each side of the rough opening for the stairway. Prior to permanent installation, the adjustable stair guide and support can be extended or contracted by conjoint swinging of the upright links to adjust the rise and run of each step automatically and equally so that the total rise matches the total rise between the floors as actually constructed.

In the preferred embodiment of the invention, the stair guide and support is designed so that the upright links are always disposed at a substantial acute angle to the vertical when the total rise is within a range expected to be found on the job, so that adjustment of the rise by extension or contraction of the stair guide and support does not unduly increase the run.

DETAILED DESCRIPTION

Figures 1, 2:
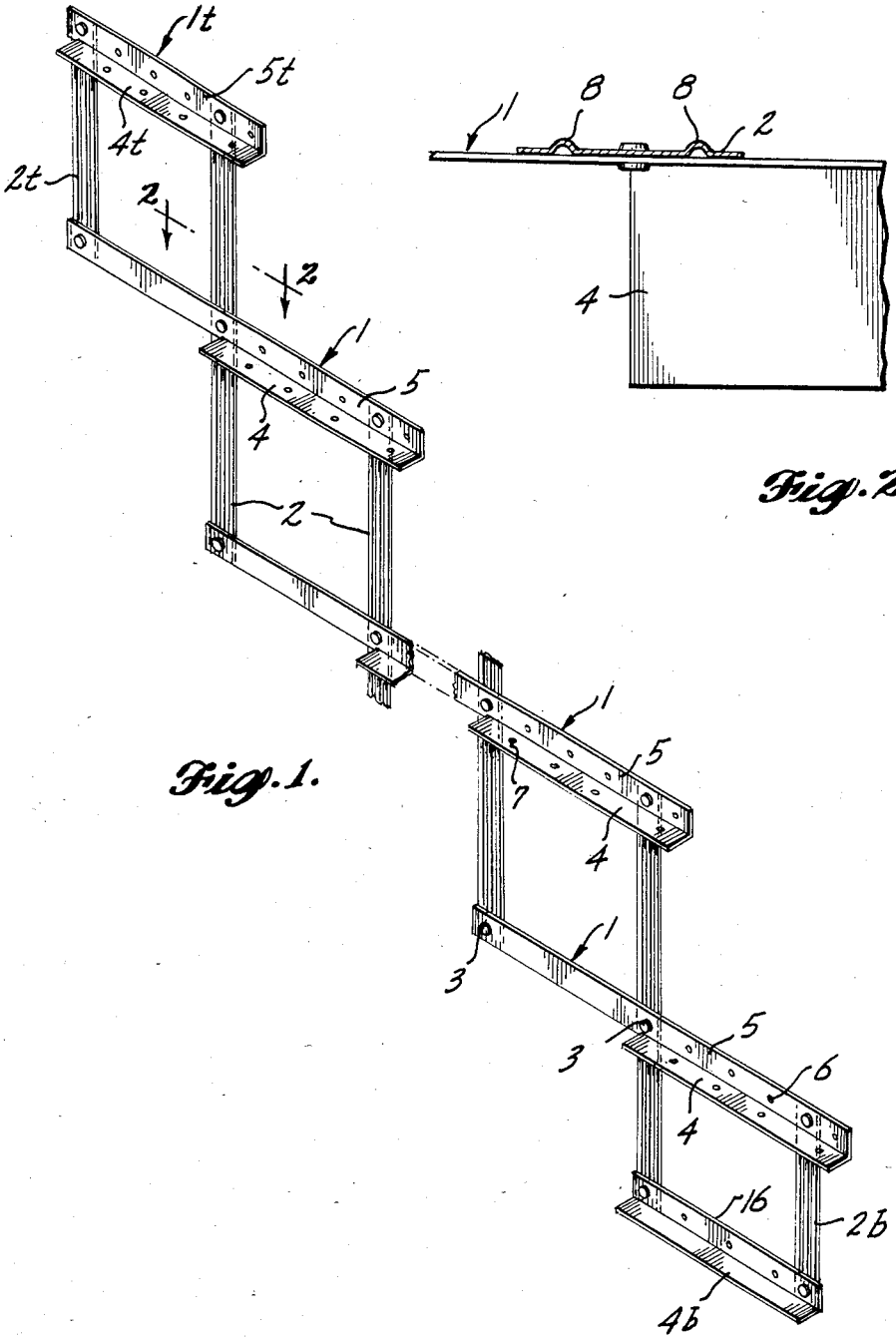
FIG. 1 is a top perspective of an adjustable stair guide and support in accordance with the present invention with parts broken away.
FIG. 2 is an enlarged, fragmentary section taken along line 2—2 of FIG. 1.

The adjustable stair guide and support of the present invention is used in constructing a permanent stairway between floors or landings of a multistory building structure. In general, two such supports are installed at opposite sides of the rough opening for the stairway to support the opposite end portions of the stair treads. Such two supports are mirror images of each other, only one of which is shown in the drawings.

As shown in FIGS. 1 and 2, the invention is in the form of a lazy tongs linkage having uniformly spaced horizontal links 1, including the top and bottom horizontal links 1*t* and 1*b*, respectively; and uniformly spaced, parallel, upright links 2, including the end upright links 2*t* and 2*b*. The horizontal and upright links are pivotally interconnected by rivets 3.

The bottom end portion of the bottom upright link 2*b* is pivoted to the leading end portion of the bottom horizontal link 1*b*, and the top end portion of such bottom upright link 2*b* is pivoted to generally the leading end portion of the next upper horizontal link. Similarly, the top upright link 2*t* has its upper and lower end portions pivoted to the trailing end portions of the top horizontal link 1*t* and the next lower horizontal link, respectively. Each of the intermediate upright links 2 has its central portion pivoted to approximately the central portion of a horizontal link 1, its upper end portion pivoted to generally the leading end portion of the next upper horizontal link, and its bottom end portion pivoted to the trailing end portion of the next lower horizontal link.

The bottom horizontal link 1*b* is of angle cross section, having a bottom flange 4*b* extending perpendicularly inward for resting on the lower floor or landing of the multistory building structure. Each of the other horizontal links 1 has a forward portion of angle cross section including a tread support flange 4 extending perpendicularly inward from the lower edge of an upwardly extending body or flange 5. Attachment holes 6 are provided through the upwardly extending flanges of the horizontal links for securing them to the conventional weight-bearing portion of the stairway, such as the framing of a sidewall or an inclined stringer. The opposite end portions of the stair treads can be secured to the tread support flanges 4 by use of attachment holes 7 in the tread support flanges.

Preferably the vertical width of the upright flange 5 of each horizontal link 1 is approximately equal to the thickness of the material used for the stair treads. For example, if nominal "2×12" lumber is used for the treads, each horizontal link 1 would be about 1½ inches (3.8 cm) high above its tread support flange 4 so that the top of the tread would be flush with the top edge of the upright flange.

One qualification must be made to the statement that the horizontal links are uniformly spaced and to the statement that the upright links are uniformly spaced. For adjacent stair treads supported on the flanges 4, the vertical distance or rise between the treads is equal to the vertical distance between the top edges of the upright flanges of the corresponding horizontal links. For the bottom step, however, the rise is equal to the vertical distance between the lower floor, that is, the bottom of the bottom horizontal link 1*b*, and the top edge of the upright flange 5 of the next upper horizontal link. So that the rise for the bottom step will be the same as for the other steps, the vertical spacing between the bottom link 1*b* and the next upper link 1 is less than the spacing between any other pair of adjacent horizontal links.

Similarly, the run of each step supported on the flanges 4 is equal to the distance between the leading end of the link 1 supporting the lower step and the leading end of the horizontal link supporting the next upper step; except for the top step supported on the flange 4*t* of the top horizontal link where the run is equal to the full length of such top link. Accordingly, so that the run of the top step is substantially equal to the run of each of the other steps, the distance between the top upright link 2*t* and the adjacent link 2 is slightly less than the distance between any other pair of the upright links.

Preferably, the leading end portion of each horizontal link 1 overhangs the link 2 or 2*b* supporting it. As best seen in FIG. 2, the upright links 2 can have stiffening ribs or corrugations 8 projecting outward away from the adjacent side of the corresponding horizontal links 1. All of the links can be sheet metal, and the flanges 4 can be bent inward from the upright bodies or flanges of the links 1.

Figure 3:
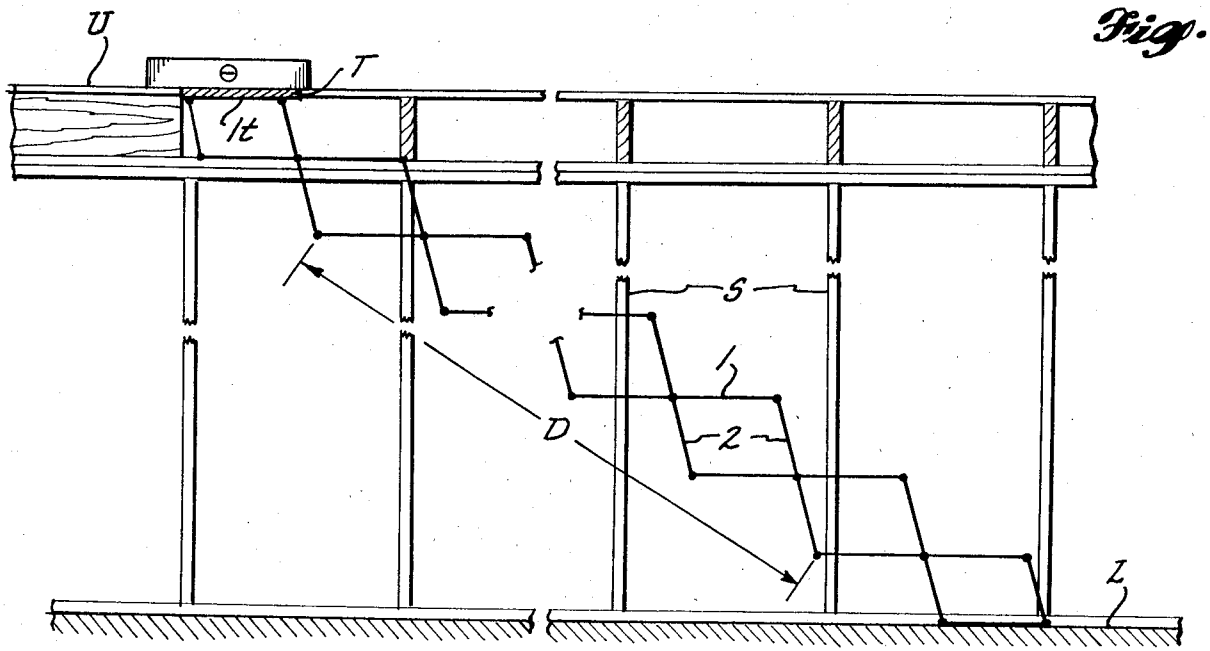
FIG. 3 is a very diagrammatic side elevation.
Figure 4:
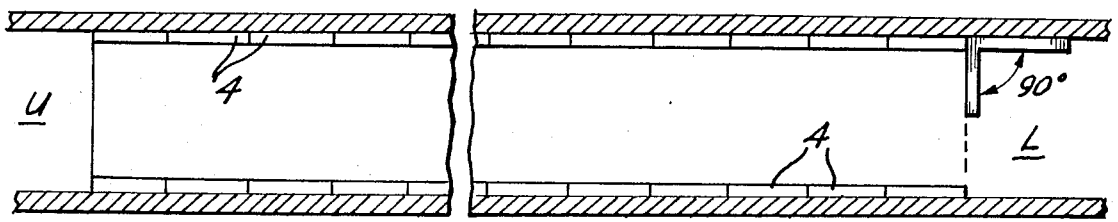
FIG. 4 a very diagrammatic top plan, of the adjustable stair guide and support shown in FIGS. 1 and 2, illustrating one method in which it can be installed in constructing a permanent staircase, with parts being broken away in each instance.
Figure 5:
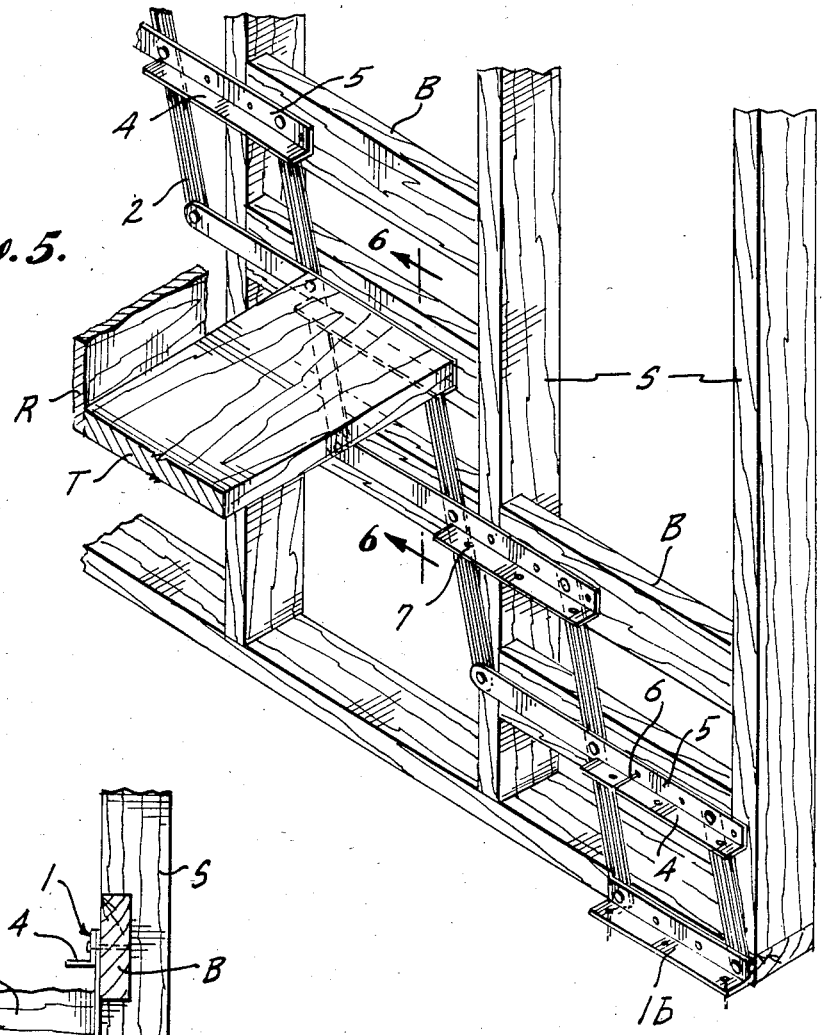
FIG. 5 is a fragmentary top perspective showing in more detail an installation of such stair guide and support in accordance with FIGS. 3 and 4.
Figure 6:
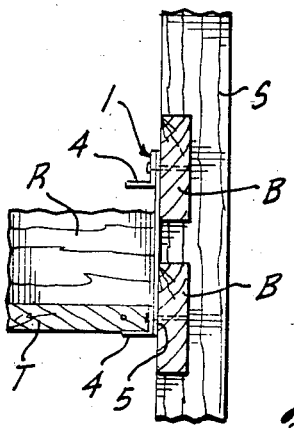
FIG. 6 is a fragmentary section taken along line 6—6 of FIG. 5.

One method of installation of the adjustable stair guide and support of the present invention in construction of a permanent stairway is diagrammatically illustrated in FIGS. 3 and 4, with the completed installation being shown in greater detail in FIGS. 5 and 6. As indicated in FIG. 3, first the stair guide and support is positioned along the appropriate sidewall of the rough opening for the stairway. The top edge of the top horizontal link 1*t* is maintained level with the upper surface of the upper floor U while the stair guide and support is extended by conjoint, counterclockwise swinging of the upright links until the bottom horizontal link 1*b* bears on the upper surface of the lower floor L. The places where the horizontal links cross the studs S of the sidewall are marked on the studs and, as best seen in FIG. 5, blocks B are secured between the studs. Then the stair guide and support is secured to the blocks by nails or screws extending through the attachment holes 6.

Another stair guide and support in accordance with the invention is positioned and secured by a similar procedure to the sidewall at the other side of the stairway rough opening. Rather than leveling the top link of such other stair guide and support, however, preferably the leading end of the bottom horizontal link is positioned so that the total run of the second stair guide and support is the same as the total run for the first installed stair guide and support, as diagrammatically indicated in FIG. 4. Again, blocks are secured between the studs of the opposite sidewall and the horizontal links are secured to the blocks.

Next, the stair treads T are installed and may be fixed in position by screws extending upward through the attachment holes 7 in the tread-supporting flanges 4, or the ends of the treads can be simply toenailed into the blocks. The bottom margins of risers R can be nailed to the trailing upright edges of the treads.

Figure 8:
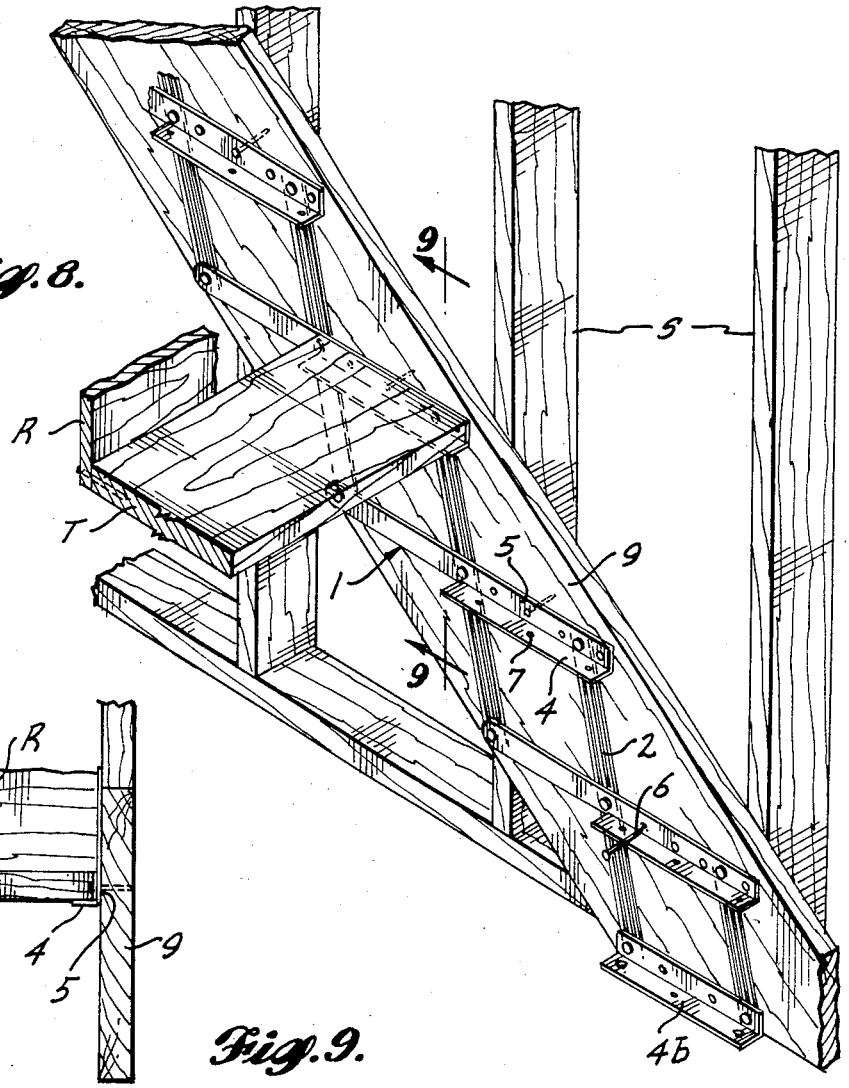
FIG. 8 is a fragmentary top perspective showing in more detail an installation in accordance with FIG. 7.
Figure 9:
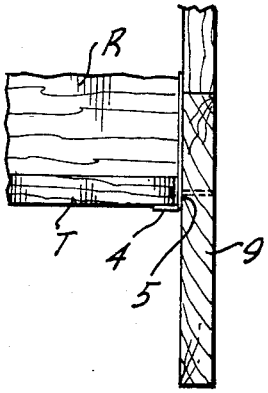
FIG. 9 is a fragmentary section taken along line 9—9 of FIG. 7.
Figure 7:
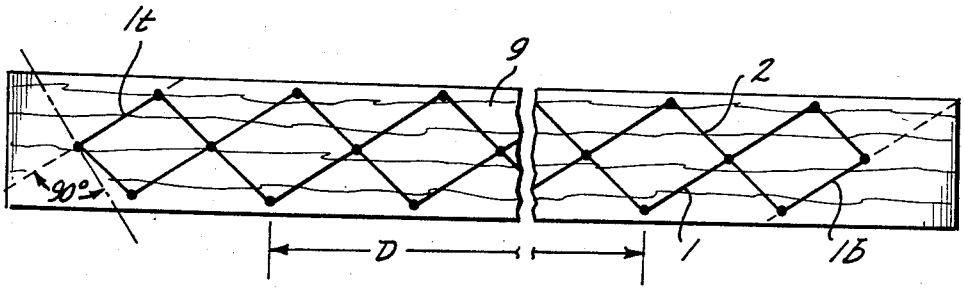
FIG. 7 is a very diagrammatic top plan illustrating one step in another method of installation of the adjustable stair guide and support shown in FIGS. 1 and 2.

In a second method of installation the adjustable stair guide and supports are mounted on inclined stringers. First one stair guide and support is positioned as indicated in FIG. 3. Then the distance D between the trailing ends of horizontal links separated by several, preferably at least five, steps is measured. As indicated in FIG. 7, the stair guide and support then is taken down and laid on a length 9 of stringer material and expanded or contracted until the distance D between the same points is the same as was measured with the support in the position shown in FIG. 3. The stringer then is cut at the top and bottom of the support as indicated by the broken lines in FIG. 7. The horizontal links of the support are secured to the stringer by nails or screws extending through the attachment holes 6, whereupon the stringer can be installed, as shown in FIG. 8, by nailing it to the sidewall studs S. The stringer for the other side of the stairway is laid out and installed in the same manner, and the treads and risers are installed as in the first method of installation.

Preferably, an adjustable stair guide and support in accordance with the present invention is designed and engineered for a specific application, the object being to provide a stairway installation that can be adapted to fit an expected range of vertical distances between floors or landings while keeping the rise and run of each step within accepted limits. By way of example, for conventional residential wood construction, the vertical distance between upper and lower floors could be expected to be between about 105 inches (2.67 m) and about 109.5 inches (2.78 m) depending on the floor joists and subflooring for the upper floor; and a representative building code may specify that the rise of each step be no more than 8 inches (20.3 cm) and the run be no less than 9 inches (22.9 cm). The adjustable stair guide and support of the present invention would have 14 steps and would be designed so that the rise could be altered within the range between a maximum of about 7.8 inches (19.8 cm) per step, for the maximum total rise of 109.5 inches (2.78 m); and a minimum rise of 7.5 inches (19.1 cm) per step, for the minimum total rise of 105 inches (2.67 m). Within this range the minimum run should be 9 inches (22.9 cm) per step for a total minimum run of 126 inches (3.2 m). As discussed further below, the maximum total run depends on the degree to which the support must be extended or contracted in order to adjust the rise.

Figure 10:
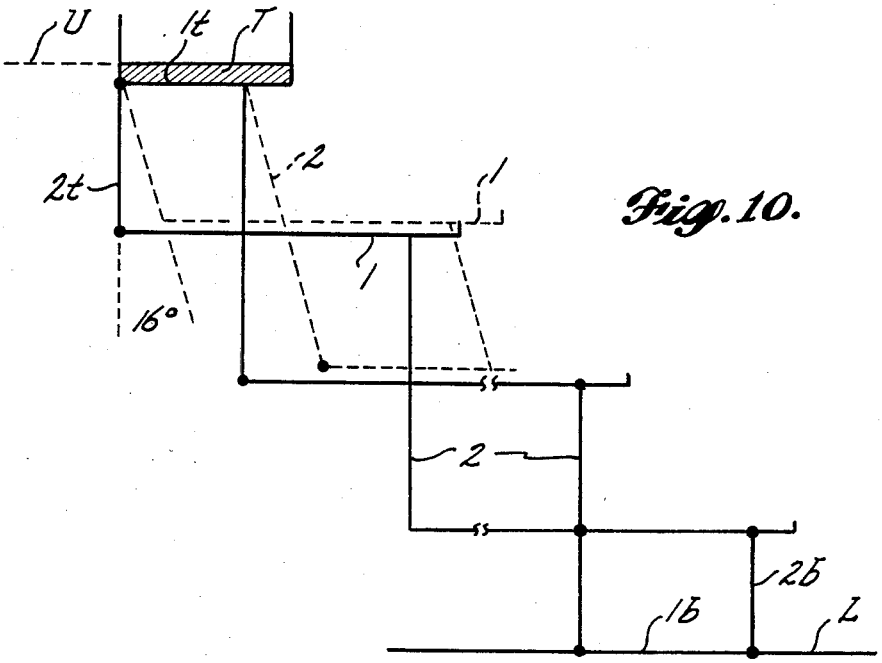
FIG. 10 is a very diagrammatic side elevation of one possible form of the invention, namely, the orthogonal form, with parts broken away.

For the conditions discussed above, one form that the invention could take is shown diagrammatically in FIG. 10. The maximum rise position of a stair guide and support in accordance with FIG. 10 would be with the upright links 2 and horizontal links 1 disposed in mutually orthogonal relationship. Accordingly, the form shown in FIG. 10 is referred to as the "orthogonal" form. In such orthogonal position, the rise of each step is about 7.8 inches (19.8 cm) and, since 14 steps are provided, the total rise is about 109.5 inches (2.78 m). If the total rise for a particular job were less than 109.5 inches (2.78 m), the adjustable stair guide and support could be either expanded or contracted by conjoint counterclockwise or clockwise swinging of the upright links 2. As shown in broken lines toward the top of FIG. 10, conjoint counterclockwise swinging of the upright links has the effect of decreasing the rise and increasing the run of each step. Clockwise conjoint swinging of the links would decrease both the rise and the run of each step.

To accommodate the minimum rise condition where the total rise is 105 inches (2.67 m), the upright links would have to be swung sufficiently to decrease the rise of each step by about 0.3 inch (7.6 mm) from 7.8 to 7.5 inches (19.8 to 19.1 cm). A problem with the orthogonal maximum rise form of the invention shown in FIG. 10 is that the upright links must be swung through a substantial angle in order to decrease the rise appreciably. In fact, starting from the orthogonal position, swinging the upright links sufficiently to decrease the rise of each step from about 7.8 inches (19.8 cm) to about 7.5 inches (19.1 cm) will change the run of each step by more than 2 inches (5.1 cm). If the stair guide and support is designed to be extended to effect the decrease in rise, the run of each step would be 9 inches (22.9 cm) in the orthogonal position and the run of each step would be greater than 11 inches (27.9 cm) in the extended minimum rise position. The total run in the minimum rise position would be greater than 154 inches (3.91 m) which results in a substantial wastage of space as comparted to the minimum run of 126 inches (3.2 m) permitted by the building code.

Similarly, if the adjustable stair guide and support is designed to be contracted to effect the reduced rise, then the run of each step in the orthogonal position would have to be greater than 11 inches (27.9 cm) in order to assure that the run is at least 9 inches (22.9 cm) in the contracted, minimum rise position.

The variation in run for a given change in rise can be reduced by designing the support of the present invention so that the upright links are disposed at a substantial acute angle, preferably at least 10 degrees, in the maximum rise position of the support. In the solid line position of the "extended" form of the invention shown in FIG. 11, the rise and run of each step is the same as for the solid line position of the orthogonal form shown in FIG. 10, but in the form of FIG. 11 the upright links 2 are inclined downward and forward in the direction of stairway descent at an angle of about 15 degrees from the vertical. In the condition shown in solid lines, preferably the rise of each step is about 7.8 inches (19.8 cm) so that the total rise of the 14 steps would be about 109.5 inches (2.78 m). For a shorter total rise between the lower and upper floors, the adjustable stair guide and support would be further extended as indicated in broken lines toward the top of FIG. 11. To fit a total rise of 105 inches (2.67 m), the extension of the stair guide and support would be sufficient to decrease the rise of each step to 7.5 inches (19.1 cm).

By starting from an angle of 15 degrees for the upright members, decreasing the rise of each step from about 7.8 to 7.5 inches (19.8 cm to 19.1 cm) results in increasing the run of each step only about 1 inch (2.5 cm). The links would be proportioned to provide a run of about 9 inches (22.9 cm) in the maximum rise position so that in the minimum rise position the run would be increased to only about 10 inches (25.4 cm).

Figure 11:
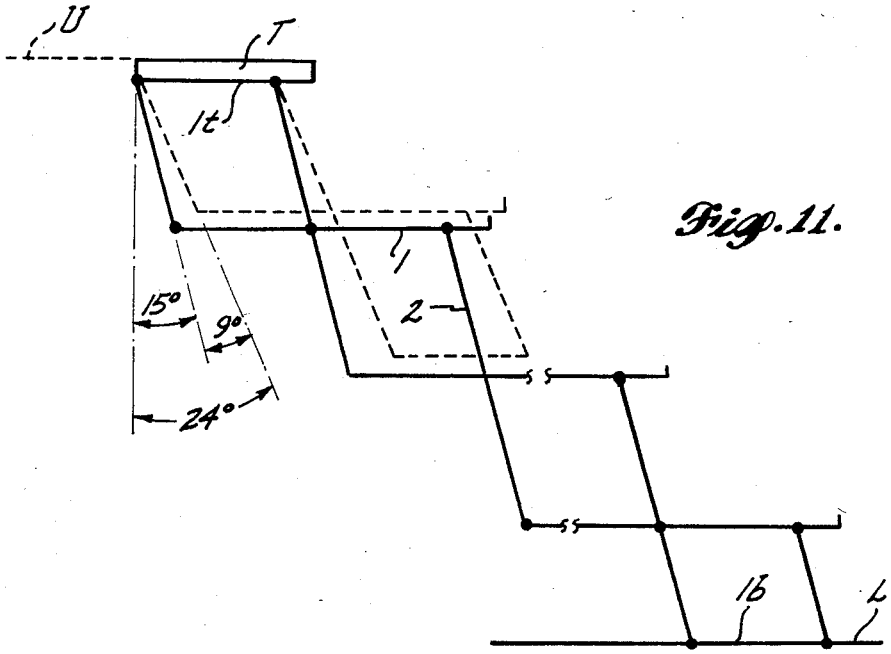
FIG. 11 is a corresponding, very diagrammatic side elevation of another possible form of the invention, namely, the extended form, with parts broken away.
Figure 12:
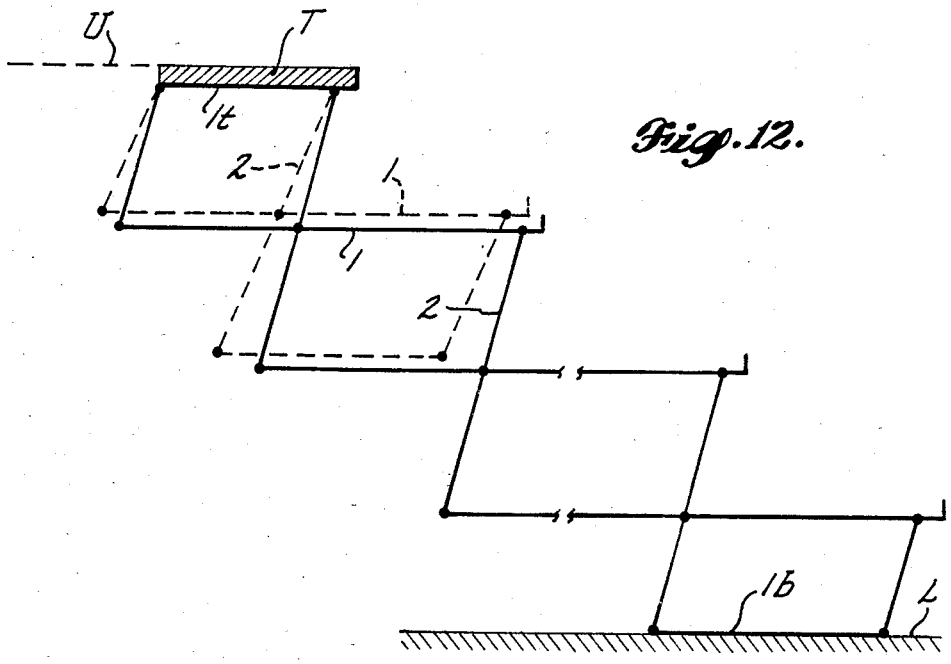
FIG. 12 is a corresponding, very diagrammatic side elevation of yet another possible form of the invention, namely, the contracted form, with parts broken away.

In the contracted form of the invention shown in FIG. 12, again the links are designed so that the upright links are disposed at an angle of about 15 degrees in the maximum rise position of the adjustable stair guide and support, but in the opposite sense from the extended form shown in FIG. 11, that is, the upright links are inclined downward and rearward with reference to the direction of stairway descent. For the solid line position shown in FIG. 12, the rise of each step would be about 7.8 inches (19.8 cm) and the run of each step would be about 10 inches (25.4 cm). If the total rise between the lower and upper floors were less than 109.5 inches (2.78 m), the stair guide and support would be further contracted as indicated in broken lines in FIG. 12. Contraction sufficient to decrease the rise of each step to 7.5 inches (19.1 cm) would result in decreasing the run of each step to about 9 inches (22.9 cm).

Figure 13:
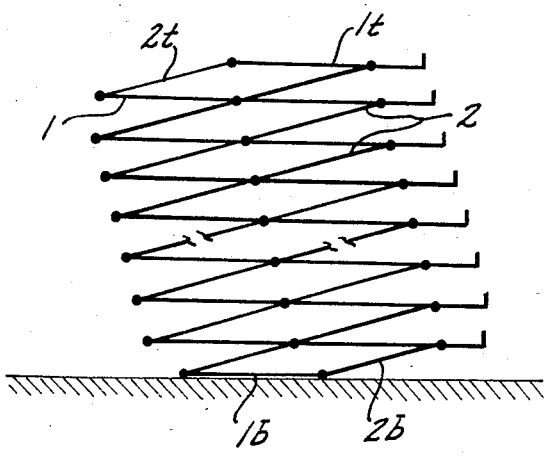
FIG. 13 is a corresponding, very diagrammatic side elevation illustrating how all three of the forms shown in FIGS. 10, 11 and 12 can be contracted for packaging, shipment or storage.

Regardless of the form of the invention that is used, contraction or extension of the adjustable stair guide and support has the effect of automatically and equally adjusting the rise and run of each step. For packaging, shipment or storage, the support can be fully contracted to compact form as indicated in FIG. 13. By designing the adjustable stair guide and support for a range of total rises to be expected, the rise and run can be kept within acceptable limits without a substantial waste of space by unduly increasing the total run of the stairway, and the entire stairway can be installed without any time-consuming calculations, lay out or notching of stringers.

I claim:

1. In a stairway construction including stair treads and fixed supports for carrying the weight of the opposite end portions, respectively, of the stair treads, the improvement comprising a stair guide and support including several horizontal links including a top horizontal link, said horizontal links being substantially uniformly spaced elevationally and having substantially horizontally extending flanges for supporting corresponding end portions of the stair treads, and several upright substantially parallel links pivoted to said horizontal links to form a lazy tongs linkage in inclined attitude, said horizontal links being immovably secured to the weight-bearing supports in fixed relative relationship and said upright links extending at a substantial acute angle to the vertical.

2. The stairway construction defined in claim 1, in which the upright links are inclined downward and outward relative to the top horizontal link at a substantial acute angle to the vertical.

3. The stairway construction defined in claim 2, in which the substantial acute angle is at least 10 degrees.

4. The method of constructing a permanent stairway between adjacent upper and lower floors of a multistory building structure which comprises changing the degree of inclination from vertical of the upright links of a lazy tongs linkage having several horizontal links substantially uniformly spaced elevationally and thereby simultaneously altering the elevational spacing between the horizontal links so that the total rise of the horizontal links with the upright links in inclined attitude matches the vertical distance between such adjacent floors, immovably securing the linkage to fixed weight-bearing supports to maintain the horizontal and upright links in fixed relative positions, and installing stair treads with corresponding end portions thereof resting on tread support flanges projecting inward from the horizontal links.

* * * * *